United States Patent [19]

Bandera et al.

[11] Patent Number: 4,739,536

[45] Date of Patent: Apr. 26, 1988

[54] SCREWDRIVER HANDGRIP HAVING HARDER AND SOFTER ZONES

[75] Inventors: Jan-Eric Bandera; Peter Kern; Roland Schindhelm, all of Stuttgart; Johannes Solf, Sindelfingen; Karl Lieser, Wuppertal, all of Fed. Rep. of Germany

[73] Assignee: Wera Werk Hermann Werner GmbH & Co., Fed. Rep. of Germany

[21] Appl. No.: 882,342

[22] Filed: Jul. 7, 1986

[30] Foreign Application Priority Data

Jul. 13, 1985 [DE] Fed. Rep. of Germany ..... 3525163
Jun. 19, 1986 [EP] European Pat. Off. ..... 86 108 371.5

[51] Int. Cl.[4] ..... B25G 1/10

[52] U.S. Cl. ..... 16/111 R; 16/DIG. 12; 81/177.6; 81/492

[58] Field of Search ..... 16/111 R, 111 A, 116 R, 16/DIG. 12; 74/551.9, 558; 81/177.1, 177.6, 427.5, 489, 490, 491, 492

[56] References Cited

U.S. PATENT DOCUMENTS 835,149 11/1906 Anderson ..... 81/177.1 X
1,250,508 12/1917 Renkenberger .
1,511,434 10/1924 Thomson ..... 81/177.1 X
2,614,155 10/1952 Lippy ..... 74/558 X
2,871,899 2/1959 Coyle et al. .
3,185,001 5/1965 Viator ..... 81/177.1
3,302,673 2/1967 Forsberg .
3,343,577 9/1964 Wagner ..... 81/177.1
3,500,973 3/1970 Bush ..... 16/111 R
4,452,289 6/1984 Smith .

FOREIGN PATENT DOCUMENTS 1298060 2/1970 Fed. Rep. of Germany .
2307186 8/1974 Fed. Rep. of Germany .

*Primary Examiner*—Fred Silverberg
*Attorney, Agent, or Firm*—Wood, Herron & Evans

[57] ABSTRACT

A handle for tools, specifically for screwdrivers, is disclosed. The handle consists of two materials of different hardness, of which the harder material supporting the tool is incompressible under the forces occurring at operational load, whereas the other material permits slight elastic deformations under forces of load. In order to obtain a hand-sympathetic design which nevertheless transmits high torques, the two gripping zones of softer material are situated adjacent to a gripping zone of harder material located between them.

15 Claims, 6 Drawing Sheets

SCREWDRIVER HANDGRIP HAVING HARDER AND SOFTER ZONES

BACKGROUND OF THE INVENTION

The invention concerns a handle for tools, specifically screwdrivers, and is particularly directed to tool handles of the type in which the handle consists of two materials of different hardness. The harder material supporting the tool is not deformable under the forces occurring at operating load, whereas the other material permits slight elastic deformation under load forces. The outside surface of the handle in the axial direction includes successive zones of harder and softer materials.

A handle of this type is disclosed in U.S. Pat. No. 2,871,899. The outside surface of the handle there shown includes, as viewed in its longitudinal direction, successive gripping zones of harder and softer materials. This is accomplished by flexible body sheathing covering a partial length of the cylindrical handle body, with the end area toward the tool amounting to about one-third of the overall length being exposed as a harder gripping zone. To secure it in place, the applied sleeve-type sheathing includes projections which are located inside and are aligned axially with corresponding grooves of the handle core. Such a sheathing of rubber-like material, which can be considered as a substantially complete sheathing, is disadvantageous in use; it proves to be "spongy". Especially in sustained use, irritations and even inflammations are caused by walking wrinkles and increased static friction. As a result, the tool is unsuited for sustained use. The short, harder gripping zone is additionally reduced in diameter and is primarily used for so-called "twisting", that is, for starting the screw under light load. The application of a higher torque is reserved, though, to the area of the handle end with the soft sheathing.

Another handle is disclosed in German Patent Document No. 1 298 060 which describes a screwdriver handle which is specifically designed for applying a high torque. This handle enables a good seating of the handle in the operator's hand. A plurality of separate flutes are arranged on the circumference of the handle body in angled relationship to one another. These separate flutings provide a safe grip.

The problem underlying the invention is to provide a tool of the type in question which is simple to manufacture and advantageous in use. The handle enables torques to be transmitted and the grip is considerably improved and is more sympathetic to the hand.

SUMMARY OF THE INVENTION

The present invention is predicated upon the concept of providing a tool handle for screwdrivers which includes axially alternating gripping zones of a softer and a harder material, with the endwise zones of softer material being disposed on opposite sides of the intermediate zone of harder material.

Due to such design, a handle of increased utility is obtained: The operator's hand does not lose its grip on the incompressible material of the handle. On the other hand, the proportional area of softer material is reduced so that the disadvantages of the prior art handles no longer occur in sustained use. The balanced distribution of the hard and soft materials results in the desired grip-sympathetic seating of the handle in the operator's hand and in the ability to apply greater torques. This is optimized in a preferred embodiment by making the intermediate zone of harder material the zone with the greatest diameter, while the adjacent gripping zones from soft material have the shape of truncated cones tapering toward the ends of the handle. The result is sort of a barrel shape.

The ring-type intermediate zone having the largest diameter and resting in the center of the hand is thus available as a hard surface for application of a high torque. It has the greatest lever length (rotationally symmetrical) and forms a stable guide zone for regripping. In contrast, the axially adjacent gripping zones on both ends yield elastically. Additionally, the speed of driving the screw is increased due to the truncated cores of smaller cross-section. The so-called "twisting" action can be applied to those areas. It has also been found preferable for the gripping zones of softer material to be interrupted in a circumferential direction by intervening sections of harder material. This provides a more uniform, balanced hard/soft distribution of the available gripping surface.

A handle which equals the grip-sympathetic design of the tool handle of German Patent Document No. 1 298 060, with the additional advantage of an improved grip, is obtained by configuring the gripping zones of softer material as separate flutes which extend up into the intermediate zone. The circular intermediate zone embedded in the elastic gripping substance in the fashion of a wheel body is thus structurally completely included in the measure aiming to achieve a good grip. A polygonal body is provided by the cross-sectional area of the separate flutes. In a preferred embodiment, the end face of the handle on the far side of the blade is provided with a roof-type cap of hard plastic. This makes it possible to exert thrust forces on the handle without any danger of injuring the user's palm. Furthermore, good slip protection is provided for the hollow of the user's hand resting on the handle, whereas the other hand engages in the "twisting". Such a cap will even withstand hammer blows.

In a preferred embodiment, the tapered section of the handle on the blade side is merged into a circular flute which consists of an elastically yielding material. Thus, a flexible section enhancing the grip is also obtained in the area near the blade. Preferably, both tapering grip zones are in the form of elastic shells around a hard plastic core. The deformation forces are therefore distributed to areas of the tool handle which are supported by harder material.

The shells are molded and connected by way of tunnel-type recesses in the intermediate zone. Preferably, circular grooves are provided in the end faces of the intermediate zone so that the connecting zone between both material types is enlarged. The "joint" results in a large material concentration so that a tearing or splitting of the two bonded materials forming the tool handle will not occur. The circular ring zone is preferred especially on larger handles to a multiple-edged ring zone. If the former is present, the multiple edge form of the end area near the blade offers the advantage that the handle will not roll away when laid down.

In another embodiment, it has been found advantageous to provide grip zones of softer material designed as cushions which are inserted in recesses of the basic body consisting of harder plastic. This type of individual grip zone distribution in the body makes it possible to use various degrees of softness so that a quite specific or individual outfitting of the handle becomes possible.

Alternating degrees of hardness of adjacent soft cushions can also be used. A simple and, at the same time, durable fastening is obtained by providing the recesses with relieved side walls for retaining the cushions inserted in form-fitting fashion. When using especially soft cushion material, an additional retention by gluing may be employed. The interfaces between soft and hard can be made unobjectionable by allowing the upper area of the cushion to overlap the edge of the recess.

In such an embodiment, the cushions are mushroom-shaped with their top side having a convex curvature. In this way, the cushions assume an exposed position relative to the harder basic body of the handle. The skin of the operator's hand bears on the harder grip zones primarily only after compression of the overlapping area. Additionally, the invention contemplates that the cushions be inserted in the area of the individual flutes and form in relation to the concave flute a transversely convex top side. In such an embodiment, the cushions are outwardly concave, while the cushion backs are transversely crowned.

In terms of manufacturing, it is advantageous to utilize cushions which have identical shapes. If cushion shapes are used which depart from a symmetric design, the identically-shaped cushions are preferably inserted in the two truncated cones, reversed relative to each other, because they can increase in width in the direction of the larger cross-section intermediate zone of the handle.

The above objects and advantages of the present invention will be more fully explained hereafter with the aid of pictorially illustrated embodiments.

DESCRIPTION OF PREFERRED EMBODIMENTS

Figure 1:
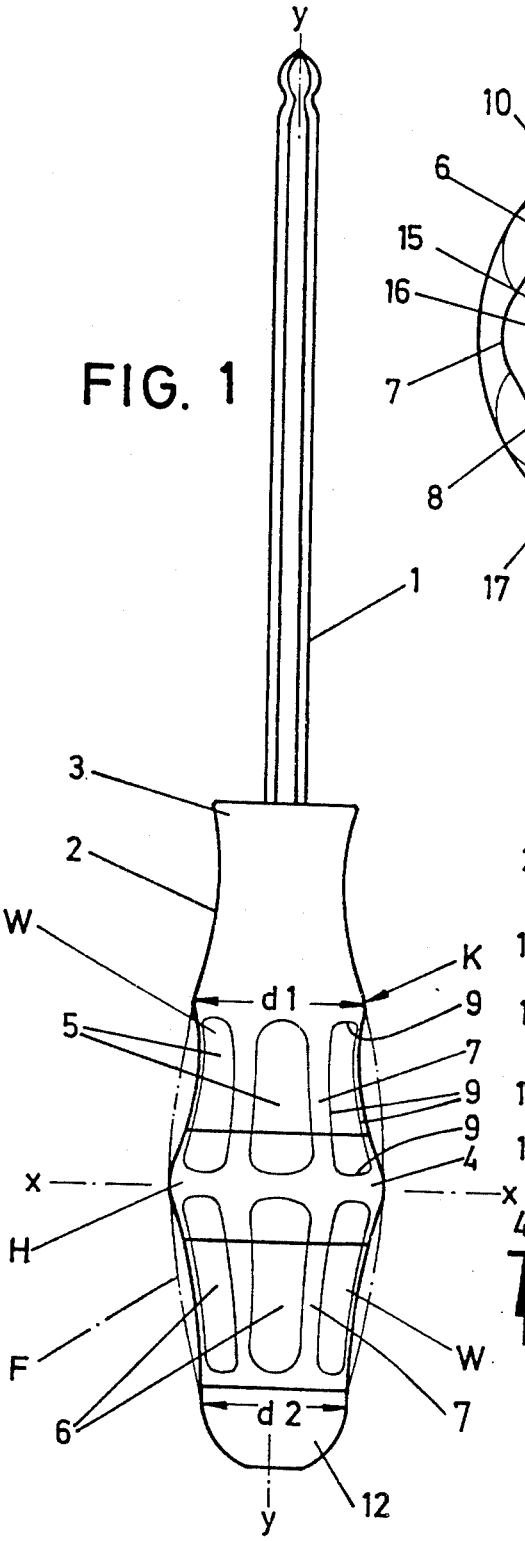
FIG. 1 is a side elevational view of a screw driver equipped with a preferred form of handle embodying the present invention.
Figure 4:
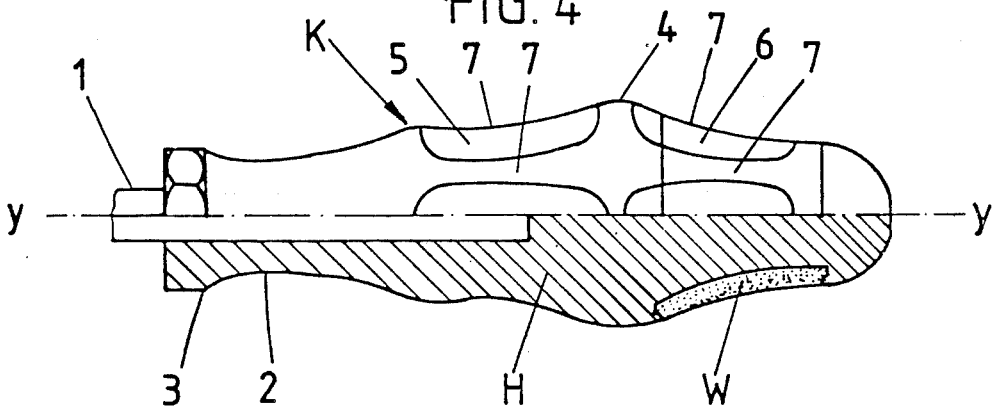
FIG. 4 is an elevational view of a modified handle.
Figure 7:
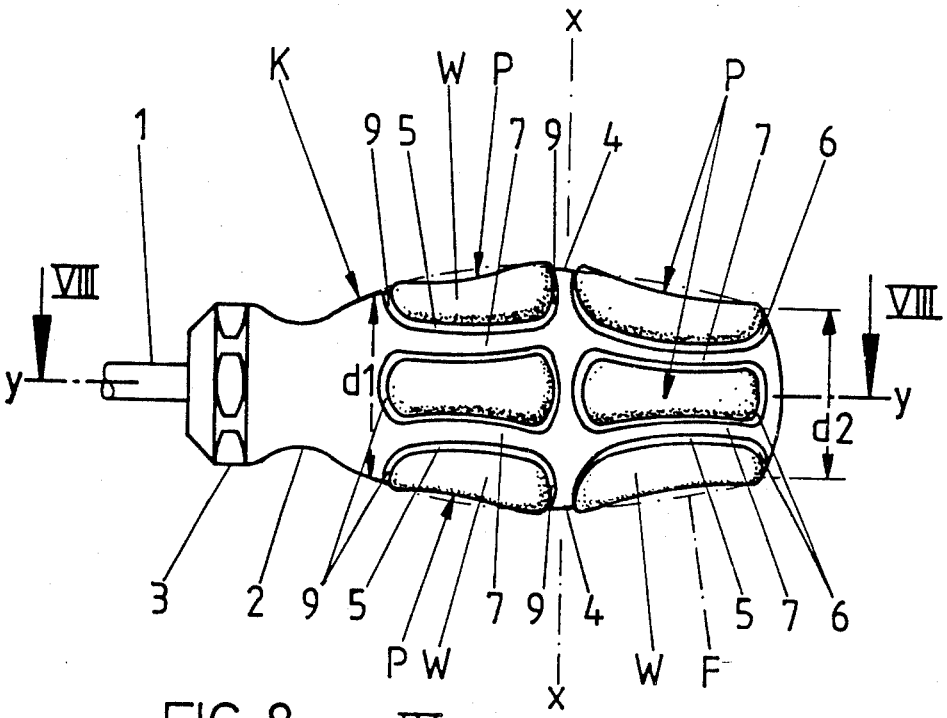
FIG. 7 is a side elevational view of a screwdriver provided with a handle longitudinally of a further embodiment.

As shown in FIG. 1, a cross-sectional hexagonal screwdriver blade 1 is incorporated in a preferred form of handle K constructed in accordance with the present invention. The screwdriver handle includes on its end adjacent the blade a circular flute 2 extending toward the end of the handle and joining a collar 3. As shown in FIGS. 4 and 7, collar 3 may be of polygonal shape.

The handle portion bordering on the other end of the circular flute 2 has a shape varying from the basic barrel shape (shown by dash-dot line F in FIGS. 1 and 7). The design of the body is such that on both sides of a ring zone 4, situated in the plane X—X extending transverse to the blade 1 of the largest handle body diameter D, there extend individual flutes 5 and 6. These flutes extend in the longitudinal direction of the handle body K. They are concave in this direction in such a way that the individual flutes 5, 6 slope from the ring zone 4 of the largest handle body diameter D up to the smaller body diameters d1 and d2. Two sections thus extend on both sides of the largest handle diameter which taper in truncated cone fashion. These truncated cones face each other with their large diameter bases.

Adjacent individual flutes 5 and 6 are juxtaposed lengthwise and border on one another forming a crown edge 7 which is concave as well. The crown edge is convex and transversely rounded.

Figure 3:
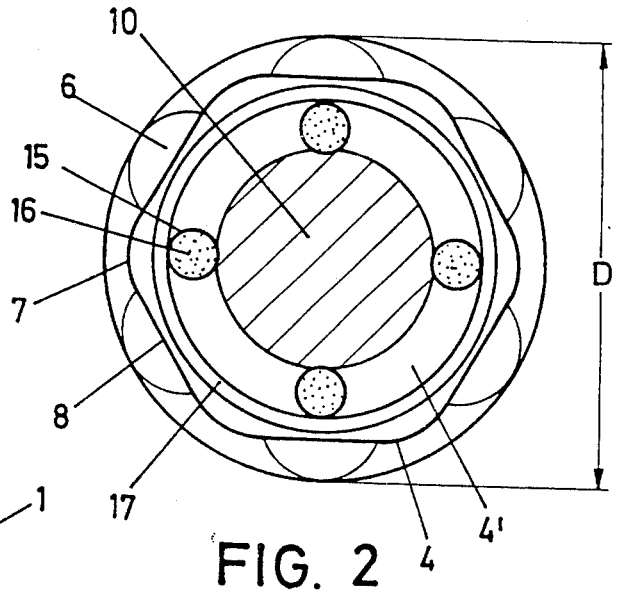
FIG. 3 is a cross-sectional view taken along line III—III of FIG. 2, the view being enlarged relative to FIG. 2.
Figure 10:
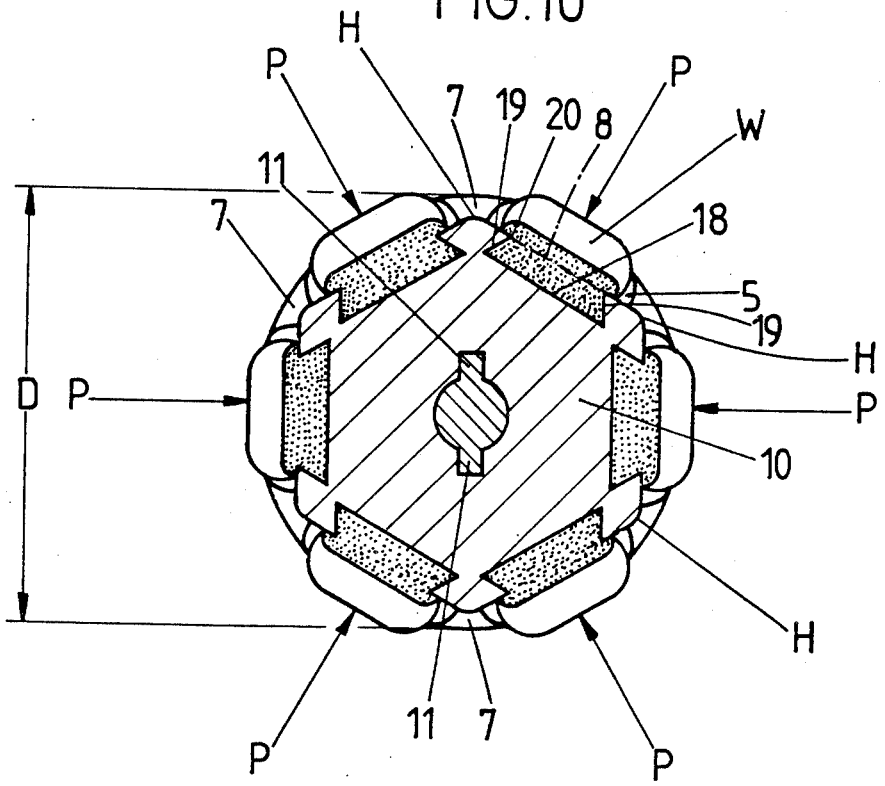
FIG. 10 is a cross-sectional view taken along line X—X of FIG. 8, the view being enlarged relative to FIG. 8.

The individual flutes 5 and 7 are arranged angularly symmetric around the longitudinal center axis Y—Y of the handle body K. Viewed in circumferential direction, the individual flutes 5, 6 form a straight wall 8 (see FIGS. 3 and 10) which, however, may also be slightly concave. In a preferred embodiment, the angular distance between the individual flutes is 60°.

The marginal edges 9 of the individual flutes 5 and 6 are rounded both in transverse and longitudinal direction of the handle body K. The edges are rounded only to a point such that the edges produced by the fluting are chamfered while retaining a multifaceted basic shape with a maximum grip.

The gripping face of the handle body K contains many facets and comprises hard and soft elastic gripping zones. For instance, the tapered zones according to FIG. 2, that is, the two truncated cones, are fashioned as soft gripping zones W, i.e., they consist on the outside for most of the elastically-yielding, compressible material, for instance, soft plastic, rubber or similar. Situated in-between, and having the larger diameter D, the intermediate zone 4 with the shape of a circular ring consists of hard, incompressible material, specifically, hard plastic, and forms with its exposed outside surface the hard gripping zones H. The individual flutes 5 or 6, respectively, located in the tapered zones extend also into the hard plastic intermediate zone 4. This zone shares about one-third to one-fourth of the surface.

Figure 2:
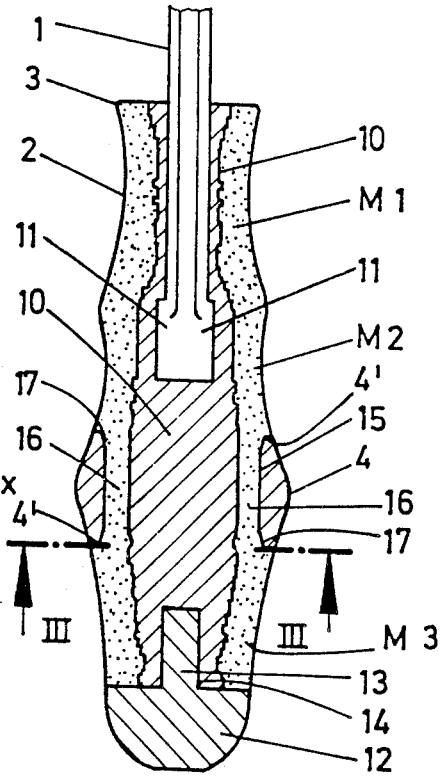
FIG. 2 is a partial, longitudinal cross-sectional view of the handle of FIG. 1 with only a portion of the blade being shown.

The annular flute 2 adjacent to the zone tapering toward the blade end consists of elastic flexible material (see FIG. 2). This circular flute section is relatively slightly fluted. It has a hard plastic core 10 into which the handle end of screwdriver blade 1, provided with flat wings 11, is molded. Such wings can be produced by flattening the shaft of the blade which is hexagonal in cross-section. The elastic flexible zone thus forms a shell M1 (FIG. 2).

As shown in FIG. 2, the hard plastic core 10 extends substantially across the entire length of the handle body K. This section is marked 10'. Thus, both tapered sections are provided in the form of elastic shells M2, M3 around the hard plastic core 10/10'. The thickness of the shells M1, M2, M3 is essentially consistent, resulting in an equivalent elasticity of the soft areas. The fingers of the user's hand do not "drown" in elastic material. The core rather provides a stabilizing base.

The end face of the handle remote from the blade is provided with a cap 12 of hard plastic. This may be a separately molded and retroactively-installed component (such as presented in FIG. 2) or may alternatively be molded with the remainder of the cap. Making cap 12 a separate component is preferable if the cap 12 consists of still harder material as might be used, for instance, if the tool handle is to be used on chisels. In the multiple-part version, a central pin 13 of the cap enters a form-fitting recess 14 of the end section of the hard plastic core 10.

The crowned cap surface extends evenly into the tapered zone of elastic material.

As shown in FIG. 2, the surface of the hard plastic core 10/10' roughly corresponds to the surface shape of the handle body and is crosswise heavily grooved or stepped. This results in an intimate bonding of the shell-forming elastic material. Such a core structure proves to be advantageous especially when the shells M1 through M3 are molded on the core. To attain a still more intimate bonding of the elastic sheathing interrupted by the hard plastic intermediate zone 4, the shells M2 and M3 are interconnected by tunnels 15 in the intermediate zone. A total of four such tunnels are provided at equal angles. The material bridges connecting the two shells M2 and M3 with each other in concealed fashion are marked 16. The tunnels 15 are longitudinal bores which extend parallel to the longitudinal center axis y—y and are equally spaced.

The end faces 4' of the ring-shaped intermediate zone 4 include annular grooves 17. As a result, the bordering soft material can extend, practically in roof fashion, underneath the marginal edge of the hard plastic ring zone 4. This leads to a larger joint area and thus to a good bond.

The individual flutes rise slightly, especially in the handle body area on the near side of the blade. As the phalanx of the index finger is placed in the annular flute 2, the thumb finds as a countermember, that is, its end phalanx in the individual flute 5, a favorable support position, thereby facilitating a quick and easy turning (so-called twisting) of the screwdriver, which in driving a screw is one of the main functions of the screwdriver prior to tightening.

In the process, the particular fold between the center phalanx and the end phalanx is situated at the ridge point of the circular intermediate zone 4 with the greatest diameter D of the handle body K. Seated in this way, the thumb is afforded its greatest contact area. The ball of the thumb and the wrist can thus intimately close around the handle body K. The other fingers gripping the body K are afforded equally favorable seating positions in the individual flutes 5 and 6, with the handle body design in modification of a basic barrel shape allowing fully for the varying length of the individual finger phalanxes and the position of the fingers. The individual flutes 5, 6 and their specific geometric arrangement provide optimum seating surfaces for the fingers and prevent the danger that the hand will slip off the handle body K.

Figure 5:
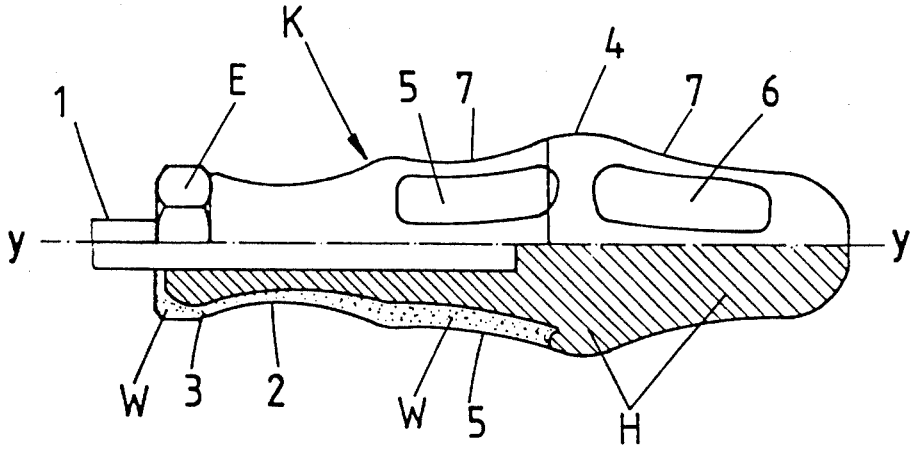
FIG. 5 is an elevational view of another modified handle.
Figure 6:
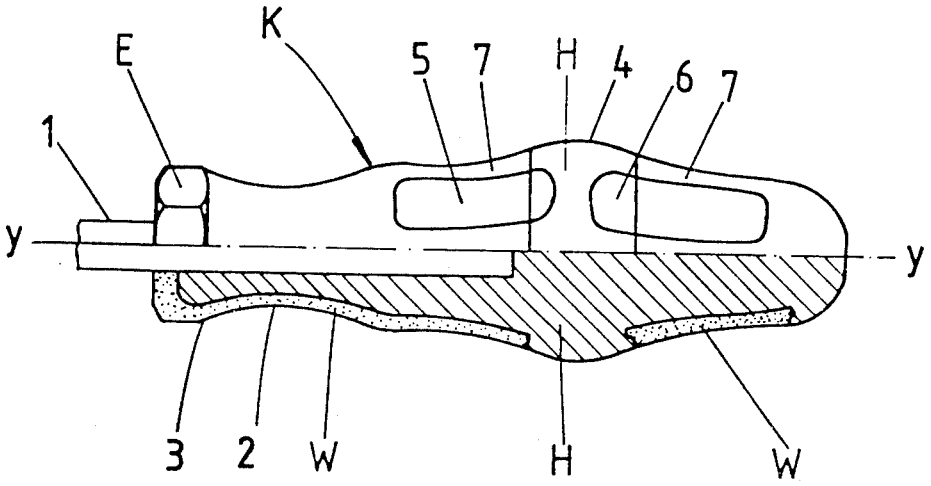
FIG. 6 is an elevational view of yet another modified handle.

The surface is heavily faceted to enable a certain adaptation to different amounts of compression, since the elastic flexible gripping zones W enable an appropriate adaptation. Yet, a high torque can be produced by employing the harder ring zone that possesses the greatest diameter. In the embodiments shown in FIGS. 4–6, the flexible material surfaces W and the hard plastic areas H are differently distributed. The soft material extends up into a polygonal end section E as a roll-prevention means, this section being sufficiently large to make contact with the adjacent surface due to the blade weight when the handle is lying on its side.

Figure 11:
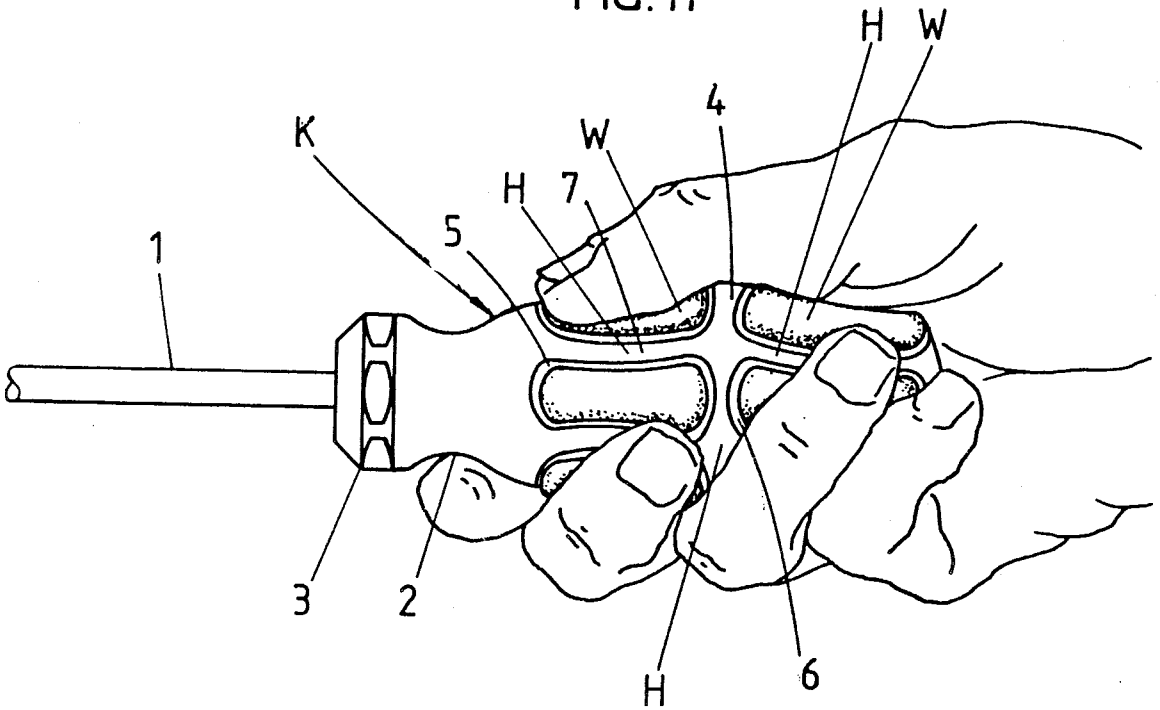
FIG. 11 is an elevational view showing the screwdriver handle being gripped in the hollow of the user's hand.

The screwdriver handle according to the embodiment illustrated in FIGS. 7 and 11 has basically the same design; the reference numbers are being used analogously, in part, without text repetitions. The two gripping zones W of softer material which are situated adjacent to the gripping zone H of harder material are divided in this embodiment on one side of the intermediate zone 4 with the maximum diameter D, i.e., are interrupted. As a consequence, the soft zone fields are located within a practically grid-type surface structure of the hard handle body K. The interruption is located in circumferential direction so that in this direction soft and hard gripping zones W and H succeed one another. Such a distribution can also be provided in the axial direction.

The gripping zones W of softer material form individual flutes which extend into the intermediate zone. The gripping zones W of softer material are designed as cushions P inserted in recesses 18 of the handle body K consisting of harder material. The handle body is hexagonal in cross-section. Six recesses 18 are located at equal angular spacing on the circumference of the tapered sections of the handle. The recesses 18 include side walls 19 which are relieved all around. The relief angle is about 20° to the bottom of the recess. The correspondingly trapezoidal foot of the cushion P seats behind the side walls 19 so that a form-fitting engagement and a good retention results for the cushion P.

In addition to this strictly form-fitting retention utilizing the elasticity of the material, the insertion may be carried out also under a certain pre-stress. Additionally, an adhesive bond may be employed. A hot-seal bonding may likewise be utilized as the cushions P are injection-molded into the recesses. For that purpose, a plastic component corresponding to the handle material is added to the cushion P which, e.g., consists of natural rubber.

The cushions P protrude beyond the bottom 8 of the individual flutes 5, 6. Viewed in cross-direction, the top side is convexly crowned. The crowning may extend across the entire transverse width of an individual flute. Alternatively, a top side crowning can be provided only near the edge so that the top side surface area remaining between the marginal transverse crowning will extend parallel to the bottom of the recesses 18.

Figure 8:
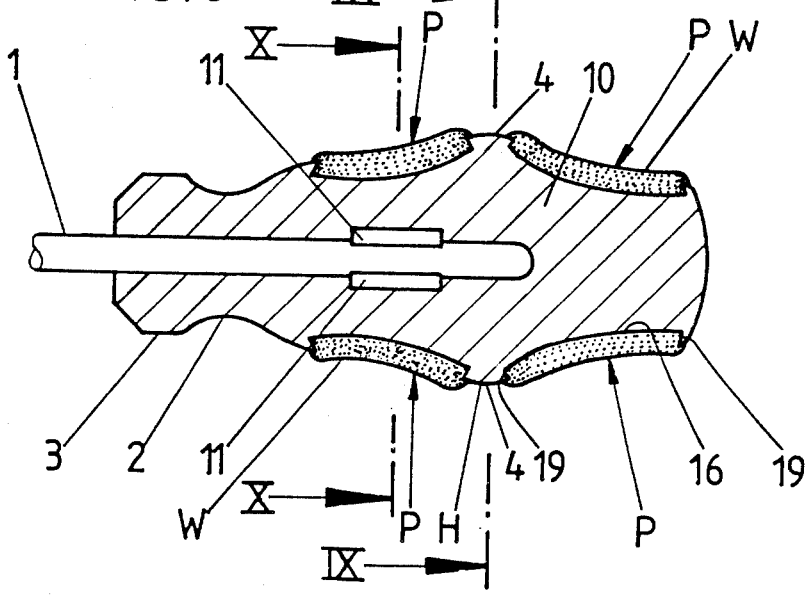
FIG. 8 is a cross-sectional view of the handle of FIG. 7.
Figure 9:
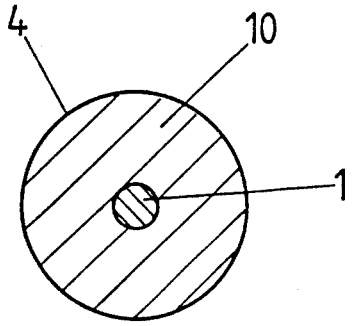
FIG. 9 is a sectional view taken along line IX—IX of FIG. 8.

The marginal area of the cushion P is rounded crosswise and overlaps the recess edge 20 in lip fashion. In axial direction, the cushions P are concavely fluted similar to the individual flutes 5, 6 (see FIG. 8). The cushion section protruding beyond the individual flutes 5 amounts to about one-third to one-fifth of the total cushion thickness.

As can be seen, the cushions P are identical (slight variations are drawing related). Owing to the individual flutes 5, 6 flairing toward the intermediate zone 4 of enlarged diameter, the cushions P have a corresponding, nearly congruent, layout. The ends of the cushions P pointing in this center direction are thereby somewhat wider. Consequently, the procedure in assembling the handle is such that identical cushions P are inserted on the two truncated cones in a fashion reversed to one another. Alternatively, a completely symmetric cushion body can be employed.

From the above disclosure of the general principles of the present invention and description of preferred embodiments, those skilled in the art will readily comprehend various modifications to which the invention is susceptible. Therefore, we desire to be limited only by the scope of the following claims:

Having described our invention, we claim:

1. A tool handle for screwdrivers, said handle comprising:

a body portion formed of a first material supporting said tool;

an outside surface, said surface including two endwise gripping zones of a second material and an intermediate gripping zone of said first material, said intermediate gripping zone being disposed between said two endwise gripping zones;

said first and second materials being of different hardness;

said first material being a harder material than said second material, said first material being incompressible under the forces at operating loads of said screwdriver;

said second material permitting slight elastic deformation under said operating loads, whereby said outer surface has longitudinally alternating gripping zones of harder and softer materials;

said endwise gripping zones being interrupted in a circumferential direction and intervening sections of said first material being disposed intermediate said interrupted zones;

said intermediate zone of said first material being of a diameter larger than the diameter of said endwise gripping zones of said second material, said endwise zones being configured in the shape of truncated cones tapering toward the ends of said handle.

2. The handle of claim 1 in which said endwise gripping zones comprise individual flutes, said flutes extending into said intermediate gripping zone.

3. The handle of claim 1 further comprising a cap of hard plastic mounted on the end face of said handle remote from said tool.

4. The handle of claim 1 in which one of said endwise gripping sections tapers toward the tool, and an annular flute is disposed adjacent to said tool, said annular flute being formed of an elastic flexible material.

5. The handle of claim 1 further comprising a core of said first material, said endwise tapered gripping zones comprising shells disposed around said core.

6. The handle of claim 5 in which said shells are molded on said core, and tunnels in said intermediate zone interconnected to said shells.

7. The handle of claim 1 in which said intermediate gripping zone includes end faces and annular grooves in said end faces.

8. The handle of claim 1 in which said intermediate gripping zone is of a circular cross-section and said endwise gripping zone adjacent to said tool has a multiple edged cross-section.

9. The handle of claim 1 in which said endwise gripping zones comprise cushions, said body portion of said first material having recesses formed therein receiving said cushions.

10. The handle of claim 9 in which said recesses have relieved side walls for retaining the cushions seated in form-fitting fashion.

11. The handle of claim 10 in which said cushions include an upper area which overlaps the walls of said recesses.

12. The handle of claim 10 in which said cushions include top sides with convex crowning.

13. The handle of claim 10 in which said handle includes longitudinally concave flutes, said cushions being inserted in recesses in the area of said flutes, said cushions being longitudinally concave and having a top side which is convex in transverse cross-section.

14. The handle of claim 8 in which all of said cushions are identical.

15. The handle of claim 8 in which certain of said cushions are nonsymmetrical and identical, said identical cushions being inserted in longitudinally-aligned recesses in said endwise gripping zones, said cushions being reversed relative to each other.

* * * * *

UNITED STATES PATENT AND TRADEMARK OFFICE

CERTIFICATE OF CORRECTION

PATENT NO. : 4,739,536

DATED : April 26, 1988

INVENTOR(S) : Bandera et al.

It is certified that error appears in the above-identified patent and that said Letters Patent is hereby corrected as shown below:

Column 4, line 24, delete "Y-Y" and insert -- y-y --

Column 8, lines 35 & 37, delete "Claim 8" and insert -- Claim 9 --

Signed and Sealed this

Eleventh Day of October, 1988

*Attest:*

DONALD J. QUIGG

*Attesting Officer*

*Commissioner of Patents and Trademarks*